United States Patent [19]

Wong

[11] Patent Number: 4,884,989

[45] Date of Patent: Dec. 5, 1989

[54] TOY FOR TUMBLING DOWN VERTICAL SURFACE

[75] Inventor: Tak K. Wong, Hong Kong, Hong Kong

[73] Assignee: T. K. Wong & Associates, Ltd., Hong Kong

[21] Appl. No.: 291,105

[22] Filed: Dec. 28, 1988

[30] Foreign Application Priority Data

Sep. 23, 1988 [GB] United Kingdom ..... 8822445

[51] Int. Cl.[4] ..... A63H 15/00

[52] U.S. Cl. ..... 446/168; 446/324; 446/431

[58] Field of Search ..... 446/168, 169, 269, 431, 446/437, 491, 291, 316, 314, 324, 465

[56] References Cited

U.S. PATENT DOCUMENTS

| | | | |
|---|---|---|---|
| 4,309,038 | 1/1982 | Spoon | 446/236 X |
| 4,764,148 | 8/1988 | Wong | 446/431 |

FOREIGN PATENT DOCUMENTS

| | | | |
|---|---|---|---|
| 55-78982 | 6/1980 | Japan | 446/431 |
| 55-78983 | 6/1980 | Japan | 446/431 |
| 55-78984 | 6/1980 | Japan | 446/431 |
| 57-58185 | 12/1982 | Japan . | |
| 1266486 | 3/1972 | United Kingdom . | |
| 2196544 | 5/1988 | United Kingdom . | |

*Primary Examiner*—Mickey Yu

*Attorney, Agent, or Firm*—Ostrolenk, Faber, Gerb & Soffen

[57] ABSTRACT

A toy which is capable of moving on a substantially vertical surface and which is provided with separated regions of a sticky material, the regions defining at least two planes in which the toy can rotate or tumble, which planes are non-parallel to each other. Preferably the toy has two parts pivotably connected together with each part bearing separated regions of the sticky material, whereby axes of rotation defined by respective pairs of the regions can be moved relative to each other.

5 Claims, 1 Drawing Sheet

TOY FOR TUMBLING DOWN VERTICAL SURFACE

This invention relates to a tumbling toy.

Granted U.S. Pat. No. 4,764,148 claims a toy comprising a shell and at least one wheel having a circumferential surface and supported to rotate relative to the shell, and a plurality of lobes angularly spaced and circumferentially and circularly extending around the wheel and projecting axially therefrom, each of the lobes having an arcuate surface with a curvature noticeably greater than that of a rotational circle enclosing the lobes, each of the lobes being constituted of a body formed of resilient material and the surfaces of the lobes comprising a sticky material.

Japanese Patent Publications Nos. 55-78982, 55-78983 and 55-78984 each disclose toys which will travel down a wall while adhering thereto, by means of a highly elastic gel layer on the surface of the toys. The toys travel down the wall either continuously or intermittently, rotating as they go.

In the prior art, the sticky material or gel layer is arranged on the toy so that rotation of the toy occurs either about a single axis only or about a plurality of axes parallel to each other.

According to a first aspect of the present invention there is provided a toy which under the influence of gravity will travel down a substantially vertical surface, which toy includes regions of sticky material which are or can be arranged relative to each other such that as the toy travels down the surface it will tumble or rotate successively about axes which are out of parallel to each other.

According to a second aspect of the present invention there is provided a toy which under the influence of gravity will travel down a substantially vertical surface, which toy includes separated regions of sticky material, pairs of said regions defining axes of rotation or tumbling of the toy, the adhesivity of the regions and the weight and/or shape of the toy being selected so that successive said regions of sticky material will adhere to the surface and then under the influence of gravity acting on the toy will become detached from the surface so as to cause the toy to rotate or tumble successively about said axes of rotation down said surface. Very preferably said defined axes of rotation are non-parallel to each other.

According to a third aspect of the present invention there is provided a toy which is capable of moving on a substantially vertical surface and which is provided with regions of a sticky material, said regions enabling the toy to travel on a said substantially vertical surface in at least two directions.

Any suitable sticky material may be employed in the toy of this invention. Examples of suitable sticky materials are disclosed in U.S. Pat. No. 4,764,148 and in the aforementioned Japanese Patent publication.

The toy of the present invention may be formed in any desired shape. In a simple embodiment the toy may be generally planar e.g. polygonal such as triangular, rectangular, square, pentagonal etc with said regions of said sticky material at corners of the toy. Alternatively the toy may be circular or disc-like with said regions located adjacent to the edge thereof and spaced thereabout.

In other embodiments the toy may be generally 3-dimensional, e.g. polyhedral such as tetrahedral or pentahedral (i.e. pyramidal), hexahedral (e.g. cubic) etc with said regions of said sticky material at apices of said polyhedral shapes. Alternatively the toy may for example be spherical with said regions of sticky material spaced about the surface thereof The toy may represent a real or fanciful machine or a real or fanciful creature. In preferred embodiments the toy is humanoid in shape, e.g. in the form of a human figure with outstretched arms. Said regions of sticky material may be provided at both hands and at the feet of the figure (i.e. three said regions) or, if the legs of the figure are apart, at both feet of the figure and at one or both hands thereof.

The parts of the toy which do not constitute said region of sticky material may be made of any desired material, such as for example plastics or metal.

An embodiment of the invention will now be described, by way of example only, by reference to the accompanying drawings, in which.

Figure 1:
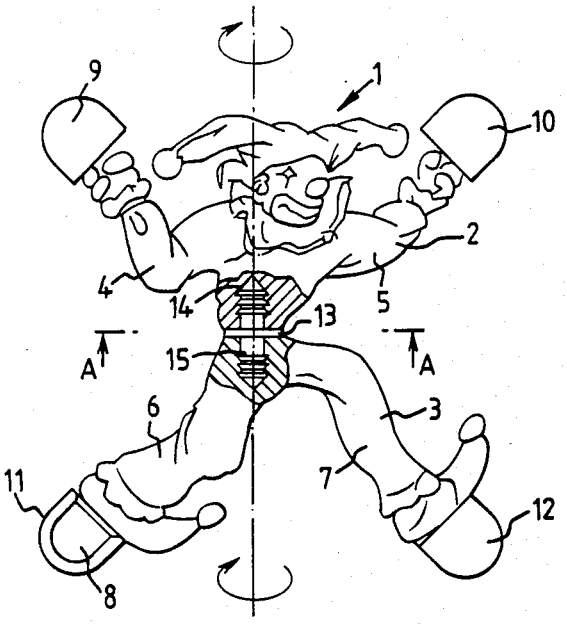
FIG. 1 is a front elevation of an embodiment of a toy according to the present invention and in a first configuration.
Figure 2:
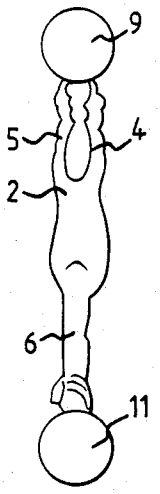
FIG. 2 is a side elevation of the toy of FIG. 1.

Referring to the drawings, a humanoid toy 1 comprises an upper half 2 and a lower half 3 each made of moulded polyvinyl chloride. The upper half 2 has arms 4,5 generally spread apart and the lower half 3 has legs 6,7 similarly spread apart. At the ends of arms 4,5 and legs 6,7 there are formed locating pegs 8 (one of which is shown in FIG. 1). A domed cap 9,10,11,12 of sticky material is located on each peg 8.

The constituents of the material of the domed caps 9,10,11,12 are selected to provide a soft or resilient material which will be readily and resiliently deformed by a weight of a few ounces.

The material includes a tackifier which imparts a tackiness or stickiness to the surface of the material. Such materials are polymeric and their constituents are well known and it is necessary only to blend suitable constituents to achieve the desired degree of deformability and tackiness according to the weight of the toy. The tackiness is such that dirt adhering to the caps 9,10,11,12 may be removed by placing a piece of adhesive tape on each cap and then removing the tape, the tape carrying off the dirt with it.

The preferred constituents of the domed caps 9,10,11,12 are polymerizing styrene, butadiene naphthenic oil, calcium carbonate and hydrogenated polyterpene resin, the latter being the tackifier.

The upper half 2 is joined to the lower half 3 of the toy 1 by means of an intermediate member 13 fitting in respective recesses 14 and 15 in halves 2,3. This member 13 allows the halves 2,3 to be swivelled relative to each other but has sufficient frictional resistance that the halves 2,3 will remain in the orientation in which they have been placed It is therefore possible to arrange the halves so that the caps 9,10 no longer lie in the same plane as caps 11,12, i.e. so that they form the apices of a tetrahedron, rather as shown in FIG. 3.

When the toy is in its planar configuration as shown in FIG. 1 and is placed on a vertical surface, the caps 9,10,11,12 will adhere to the surface. Caps 9,10 will then gradually become unstuck from the surface whereupon the toy will rotate or tumble about an axis defined by caps 11,12. This rotation or tumbling will cause caps 9,10 once more to adhere to the wall and now caps 11,12 will gradually become unstuck. The toy will therefore rotate or tumble down the wall with an intermittent or non-continuous motion. In this configuration of course the axes of rotation defined respectively by caps 9,10 and caps 11,12 are parallel so that the toy will travel essentially in a straight line down the surface.

Figure 3:
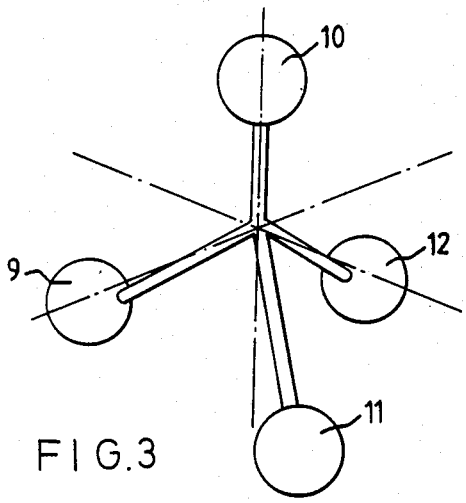
FIG. 3 is a diagrammatic representation of a second configuration into which the toy of FIGS. 1 and 2 can be put.

In the alternative configuration of FIG. 3, there will be three point contact between the domed caps and the surface. The uppermost of the caps will become unstuck thus causing the toy to rotate or tumble about an axis defined by the other two adhering caps. This in turn will cause the fourth cap to adhere to the wall. In this configuration the toy once again moves intermittently down the wall but may travel in a crabwise or zig-zag fashion.

The invention may be performed otherwise than as has been particularly described. For example, it is feasible that the toy could be self-propelled, as for example is disclosed in our co-pending British patent application No. 2,196,544A.

All changes and modifications which would be apparent to one skilled in the art lie within the scope of the present invention.

I claim:

1. A toy which under the influence of gravity will travel down a substantially vertical surface, said toy comprising two separate and pivotally connected parts adapted for being positioned one above the other on a surface, each said part including two separated regions of a sticky material, and a pair of said regions defining a respective axis of rotation or tumbling of said toy down the surface, the axis extending generally along the surface, the adhesivity of the regions of sticky material being selected so that said regions of sticky material will adhere to the surface when they first contact the surface and then under the influence of gravity acting on the toy the then upper said regions will become detached from the surface so as to free said toy to rotate or tumble successively down the surface about the said axis of rotation defined at said pair of said sticky regions still then adhering to the surface, the two said parts being pivotably connected together so that said toy is arrangeable in a first configuration in which said regions of sticky material lie in a common plane and in a second configuration in which said regions of sticky material lie at the corners of a tetrahedron.

2. A toy according to claim 1, which is generally humanoid in appearance.

3. A toy according to claim 1, in which said two parts of said toy are each comprised of a plastics material.

4. A toy according to claim 1, wherein as said toy tumbles down the surface, the said pair of regions which at a particular time define the axis vary between the two said regions of one said part and a respective one of said regions on both of said two parts.

5. A toy which under the influence of gravity will travel down a substantially vertical surface, said toy comprising two separate and pivotally connected parts adapted for being positioned one above the other on a surface, each said part including at least one region of a sticky material, a pair of said regions defining a respective axis of rotation or tumbling of said toy down the surface, the axis extending generally along the surface, the adhesivity of the regions of sticky material being selected so that said regions of sticky material will adhere to the surface when they first contact the surface and then under the influence of gravity acting on the toy the then upper said regions will become detached from the surface so as to free said toy to rotate or tumble successively down the surface about the said axis of rotation defined at said pair of said sticky regions still then adhering to the surface, the two said parts being pivotably connected together so that said toy is arrangeable in a first configuration in which said regions of sticky material lie in a common plane and in a second configuration in which said regions if sticky material lie at the corners of a polyhedron.

* * * * *